US012486758B2

(12) United States Patent
Liu et al.

(10) Patent No.: US 12,486,758 B2
(45) Date of Patent: Dec. 2, 2025

(54) REAL-TIME TOOL YIELD CALIBRATION OF MUD MOTOR

(71) Applicant: Halliburton Energy Services, Inc., Houston, TX (US)

(72) Inventors: Yang Liu, Singapore (SG); Shichao Xu, Singapore (SG); Vy Pho, Houston, TX (US); Nazli Demirer, Houston, TX (US); Ketan C. Bhaidasna, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/946,740

(22) Filed: Nov. 13, 2024

(65) Prior Publication Data

US 2025/0305409 A1 Oct. 2, 2025

Related U.S. Application Data

(60) Provisional application No. 63/573,089, filed on Apr. 2, 2024.

(51) Int. Cl.

| | |
|---|---|
| ***E21B 47/024*** | (2006.01) |
| ***E21B 7/04*** | (2006.01) |
| ***E21B 44/00*** | (2006.01) |

(52) U.S. Cl.

CPC ..... *E21B 47/024* (2013.01); *E21B 7/04* (2013.01); *E21B 44/00* (2013.01)

(58) Field of Classification Search

CPC . E21B 47/024; E21B 7/04; E21B 7/06; E21B 44/00

See application file for complete search history.

(56) References Cited

U.S. PATENT DOCUMENTS

| | | | |
|---|---|---|---|
| 10,883,341 | B2 | 1/2021 | Demirer et al. |
| 11,408,268 | B2 | 8/2022 | Zalluhoglu et al. |
| 11,739,627 | B2 | 8/2023 | Chen et al. |
| 12,006,813 | B2 | 6/2024 | Hisham et al. |
| 12,012,840 | B2 | 6/2024 | Pho et al. |
| 12,024,992 | B2 | 7/2024 | Tasoujian et al. |
| 12,024,995 | B2 | 7/2024 | Marck et al. |
| 12,044,117 | B2 | 7/2024 | Keller et al. |
| 12,055,031 | B2 | 8/2024 | Sun et al. |

(Continued)

FOREIGN PATENT DOCUMENTS

| | | |
|---|---|---|
| WO | 2023129156 | 7/2023 |

OTHER PUBLICATIONS

International Search Report and Written Opinion for International Patent Application No. PCT/US2024/057152 dated Mar. 13, 2025. PDF file. 7 pages.

*Primary Examiner* — Dany E Akakpo

(74) *Attorney, Agent, or Firm* — Benjamin Ford; C. Tumey Law Group PLLC

(57) ABSTRACT

A method that may comprise disposing a bottom hole assembly into a formation, wherein the bottom hole assembly comprises a mud motor, identifying a first segmented data set for a slide mode of the mud motor, and identifying a second segmented data set for a rotate mode of the mud motor. The method may further comprise calibrating the mud motor at least in part using a Reversible Jump Markov Chain Monte Carlo (RJMCMC), wherein the RJMCMC uses at least in part the first segmented data set and the second segmented data set.

20 Claims, 8 Drawing Sheets

(56) References Cited

U.S. PATENT DOCUMENTS

| | | | | |
|---|---|---|---|---|
| 12,123,295 | B2 | 10/2024 | Wu et al. | |
| 2009/0000823 | A1 | 1/2009 | Pirovolou | |
| 2012/0024606 | A1 | 2/2012 | Pirovolou et al. | |
| 2019/0284921 | A1* | 9/2019 | Xue | E21B 47/024 |
| 2020/0040720 | A1 | 2/2020 | Zalluhoglu et al. | |
| 2020/0072034 | A1 | 3/2020 | Zalluhoglu et al. | |
| 2020/0095860 | A1 | 3/2020 | Zalluhoglu et al. | |
| 2021/0103843 | A1 | 4/2021 | Keller et al. | |
| 2021/0293132 | A1* | 9/2021 | Panchal | E21B 44/00 |
| 2022/0120170 | A1 | 4/2022 | Marck et al. | |
| 2022/0372861 | A1 | 11/2022 | Wu et al. | |
| 2023/0096963 | A1 | 3/2023 | Demirer et al. | |
| 2023/0184081 | A1 | 6/2023 | Chen et al. | |
| 2023/0243251 | A1 | 8/2023 | Hisham et al. | |
| 2023/0272704 | A1 | 8/2023 | Demirer et al. | |
| 2024/0135072 | A1 | 4/2024 | Tian et al. | |
| 2024/0232478 | A9 | 7/2024 | Tian et al. | |
| 2024/0287890 | A1 | 8/2024 | Liu et al. | |
| 2024/0318535 | A1 | 9/2024 | Demirer et al. | |
| 2024/0352843 | A1 | 10/2024 | Tasoujian et al. | |

* cited by examiner

REAL-TIME TOOL YIELD CALIBRATION OF MUD MOTOR

CROSS REFERENCE TO RELATED APPLICATIONS

This application claims the priority of U.S. Provisional Patent Application No. 63/573,089, filed Apr. 2, 2024, which is incorporated by reference in its entirety.

BACKGROUND

Wellbores drilled into subterranean formations may enable recovery of desirable fluids (e.g., hydrocarbons) using any number of different techniques. In drilling operations, typical drilling processes may be relatively complex and involve considerable expense. Most of these operations are done manually with experienced operators running the drilling platform. There is a continual effort in the industry to develop improvement in safety, cost minimization, and efficiency. The advancements of computerized and automated systems in drilling processes are the next step in achieving these goals. With robotic and automated systems for drilling processes in early stages of development for the industry, there is a need for more efficient, improved, and optimized drilling processes.

Current methods and systems for automated drilling require calibration. For example, during drilling operation, both onshore and offshore, to control a directional well an accurate model of the system's steering behavior is needed which maps inputs to output responses. Due to numerous unknowns of the environment downhole and in the system, the model must be continually updated with measurements from the field to remain accurate and useful. These challenges are further amplified during real-time data utilization in the context of mud motor operations. In most of the drilling jobs, recording of slide and rotate modes is carried out manually, with the information only becoming available in post-job reports. Hence, detecting the steering mode in real time, along with estimation of steerability for each mode, poses a considerable challenge. Real-time identification of these parameters is very crucial in terms of accurately placing the wellbore to meet predefined objectives and constraints.

BRIEF DESCRIPTION OF THE DRAWINGS

These drawings illustrate certain aspects of some examples of the present disclosure and should not be used to limit or define the disclosure.

DETAILED DESCRIPTION

This disclosure details methods and systems for real-time calibration of the tool yield in mud motor system during the drilling process. This robust approach leverages a Bayesian statistical framework, enabling the integration of prior information or beliefs from either historical data or expert knowledge. Unlike conventional methods which rely on point estimate, this method explicitly models uncertainties via the generation of a posterior distribution for the steering parameters. Through ongoing analysis and calibration of real-time directional data measurements, the drilling system may dynamically change its steering parameters in response to changes in the subsurface environment. This adaptive capability optimizes the well trajectory in real-time, ensuring the overall success and efficiency of the drilling operation.

Figure 1:
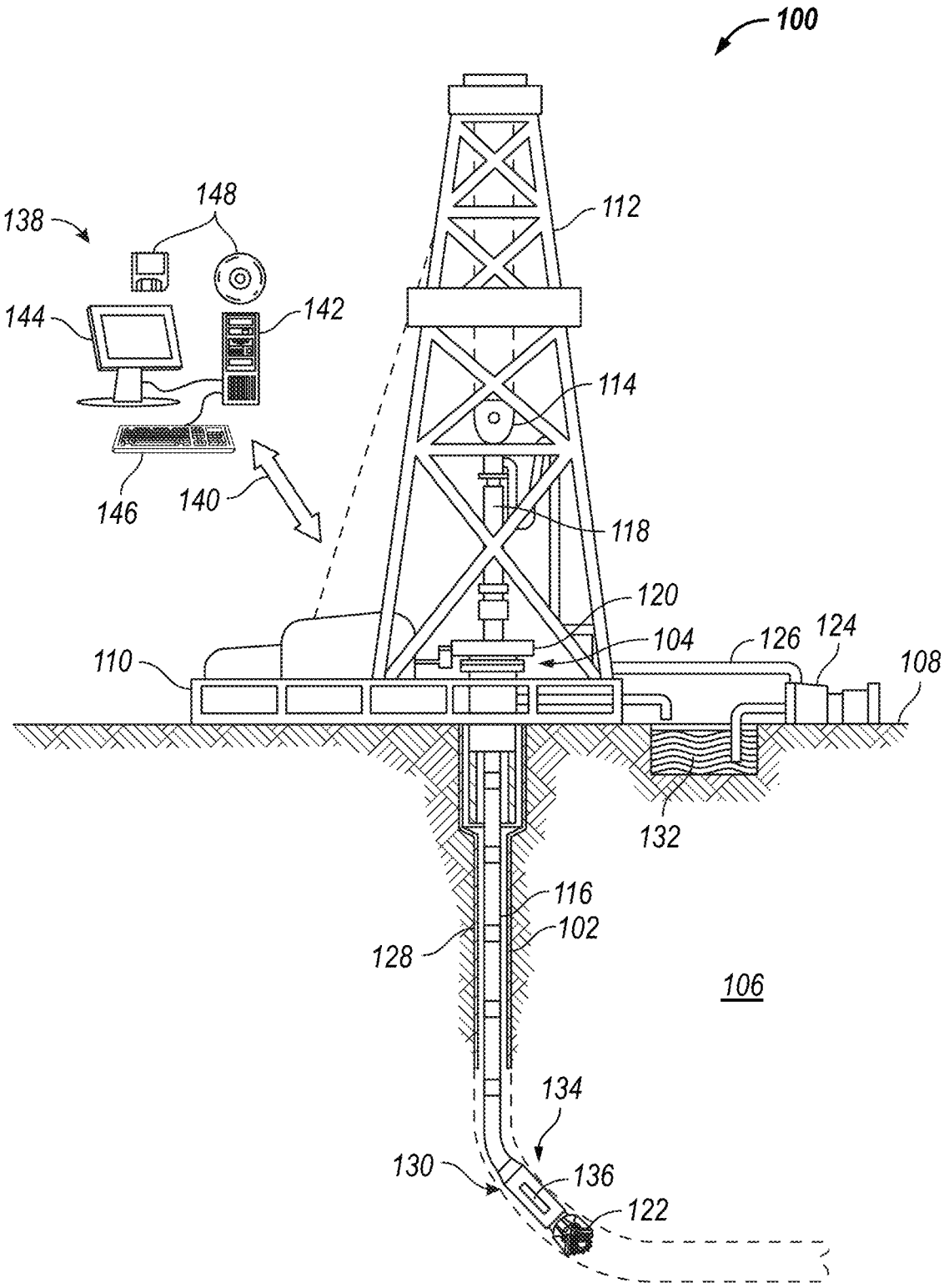
FIG. 1 illustrates an example of a drilling system and operation.

FIG. 1 illustrates an example of drilling system 100. The operations of drilling system 100 may be guided by a drilling program. In some examples, an initial drilling program may be generated prior to moving any drilling equipment to a wellsite location. In other examples, an initial drilling program may be generated prior to initiating a conductor borehole or a surface borehole. In further examples, the drilling program may be generated from a hybrid data generator which may further utilize a Large Language Model, physical models, empirical models, cost models, material supply models, and/or combinations thereof. As illustrated, wellbore 102 may extend from a wellhead 104 into a subterranean formation 106 from a surface 108. In some examples, wellbore 102 may be constructed based at least in part on a drilling program. Generally, wellbore 102 may comprise horizontal, vertical, slanted, curved, and other types of wellbore geometries and orientations. Wellbore 102 may be cased or uncased. In examples, wellbore 102 may comprise a metallic member. By way of example, the metallic member may be a casing, liner, tubing, or other elongated steel tubular disposed in wellbore 102.

As illustrated, wellbore 102 may extend through subterranean formation 106. As illustrated in FIG. 1, wellbore 102 may extend generally vertically into the subterranean formation 106, however, wellbore 102 may extend at an angle through subterranean formation 106, such as horizontal and slanted wellbores. It should further be noted that while FIG. 1 generally depicts land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may comprise, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor, a rotary steerable system ("RSS"), and/or via rotation of drill string 116 from surface 108. Without limitation, drill bit 122 may comprise roller cone bits, PDC bits, natural diamond bits, any hole openers, reamers, coring bits, cutting assemblies, and the like. As drill bit 122 rotates, it may create and extend wellbore 102 that penetrates various subterranean formations 106. In some examples, the rotational speed of the drill bit may be an operational parameter or an engineering parameter. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132. In some examples, the rate at which the drilling fluid is circulated may at least partially affect the efficacy of removing drill cuttings from the wellbore or borehole. As such, in some examples, the rate at which the drilling fluid is circulated may be an engineering parameter or an operational parameter. In some examples, the drilling fluid may comprise drilling mud which may further comprise a base fluid and additives. The base fluid may be a water-based fluid, invert emulsion, or a direct emulsion. The additives may comprise clay (e.g., bentonite), weighting agents (e.g., barite), chemical additives (e.g., shale inhibitors, scale inhibitors, flocculants, foaming agents, stabilizers, surfactants, emulsifiers, and/or friction reducers), lost circulation material, fluid loss material, lubricants, viscosifiers, thinners, and combinations thereof. During drilling operations and wellbore construction operations, parameters associated with the drilling fluid may be measured and/or recorded by sensors and/or devices. In some non-limiting examples, the drilling fluid parameters may comprise fluid density (e.g., in pounds per gallon or ppg), fluid viscosity (e.g., six-speed rheology conducted at operating pressure and temperature), fluid temperature, high-weight solids content, low-weight solids content, oil-water ratio, electric stability, chlorides concentration, calcium concentration, concentration of inhibitors, low-end rheology, fluid loss, water salinity and water phase salinity, salt type and concentration, particle size distribution (e.g., of solid additives including but not limited to lost circulation material), and combinations thereof. In some examples, the properties of a drilling fluid may change as the wellbore is extended into the subterranean formation. In further examples, adjustments may be may to the drilling fluid composition in order to maintain a set of drilling fluid properties. In some examples, the drilling fluid properties may impact drilling performance. As such, monitoring and adjusting the drilling fluid properties while the drilling operation is occurring may allow for improved and/or optimized drilling performance. In some examples, large language models may be used to analyze prior well performance and identify fluid designs which may be beneficial for drilling a given portion of a subterranean formation.

With continued reference to FIG. 1, drill string 116 may begin at wellhead 104 and may traverse wellbore 102. Drill bit 122 may be attached to a distal end of drill string 116 and may be driven, for example, either by a downhole motor and/or via rotation of drill string 116 from surface 108. In a non-limiting example, the weight of drill string 116 and bottom hole assembly may be controlled and measured while drill bit 122 is disposed within wellbore 102. In further examples, drill bit 122 may or may not be in contact with the bottom of wellbore 102. Drill bit 122 may be allowed to contact the bottom of wellbore 102 with varying amounts of weight applied to drill bit 122. The weight of drill string 116 may be measured at the surface of wellbore 102 and may be referred to as the "hook load." The difference in the hook load when drill bit 122 is suspended just above the bottom of wellbore 102 and the hook load when drill bit 122 is in contact with the bottom of wellbore 102 may be referred to as the weight-on-bit ("WOB"). Both the hook load and the weight-on-bit may be considered operational parameters and/or engineering parameters. In some examples the hook load may be measured by a hoisting system or a hook load sensor. In some examples, the hook load is measured at the surface by a sensor disposed at the surface of drilling system 100.

Drill bit 122 may be a part of bottom hole assembly 130 at the distal end of drill string 116. In some examples, bottom hole assembly 130 may further comprise tools for directional drilling applications. In other examples, directional drilling tools may be disposed anywhere along the drill string assembly. In further examples, directional drilling tools may be disposed within the wellbore using wireline, electric line, or slick line. As will be appreciated by those of ordinary skill in the art, bottom hole assembly 130 may comprise drilling equipment and directional drilling tools including but not limited to a measurement-while drilling (MWD) and/or logging-while drilling (LWD) system, magnetometers, accelerometers, agitators, bent subs, orienting subs, mud motors, rotary steerable systems (RSS), jars, vibration reduction tools, roller reamers, pad pushers, non-magnetic drilling collars, whipstocks, push-the-bit systems, point-the-bit systems, directional steering heads and other directional drilling tools. Directional drilling tools may be disposed anywhere along the drill string assembly including at the portion distal to the drilling right which may be known as the Bottom hole assembly 130 may comprise any number of tools, transmitters, and/or receivers to perform downhole measurement operations. In some scenarios, these downhole measurements produce drilling parameters which may be used to guide the drilling operation. For example, as illustrated in FIG. 1, bottom hole assembly 130 may comprise a measurement assembly 134. It should be noted that measurement assembly 134 may make up at least a part of bottom hole assembly 130. Without limitation, any number of different measurement assemblies, communication assemblies, battery assemblies, and/or the like may form bottom hole assembly 130 with measurement assembly 134. Additionally, measurement assembly 134 may form bottom hole assembly 130 itself. In examples, measurement assembly 134 may comprise at least one sensor 136, which may be disposed at the surface of measurement assembly 134. It should be noted that while FIG. 1 illustrates a single sensor 136, there may be any number of sensors disposed on or within measurement assembly 134. Without limitation, sensors may be referred to as transceivers. Further, it should be noted that there may be any number of sensors disposed along bottom hole assembly 130 at any degree from each other. In examples, sensors 136 may also comprise backing materials and matching layers. It should be noted that sensors 136 and assemblies housing sensors 136 may be removable and replaceable, for example, in the event of damage or failure. Herein, one or more sensors 136 may comprise both transmitters and receivers. In examples, one or more sensors may comprise resistivity and/or any other downhole sensors for performing resistivity, drilling parameter, and sensor data measurements. Further, one or more sensors may be performed in real time. Herein, real time may be defined as instantaneous or with computing delays.

Without limitation, bottom hole assembly 130 may be connected to and/or controlled by information handling system 138, which may be disposed on surface 108. Without limitation, information handling system 138 may be disposed down hole in bottom hole assembly 130. In addition to the sensors and measurement devices disposed on bottom hole assembly 130, information handling system 138 may be connected to sensors disposed on any other piece of equipment used in drilling system 100 including sensors disposed on the drilling platform 110, derrick 112, drill string 116, pumps 124, retention pit 132, wellhead 104, and sensors disposed within the wellbore 102 which are not connected to the drill string 116 or bottom hole assembly 130. Processing of information recorded may occur down hole and/or on surface 108. Processing occurring downhole may be transmitted to surface 108 to be recorded, observed, and/or further analyzed. Additionally, information recorded on information handling system 138 that may be disposed down hole may be stored until bottom hole assembly 130 may be brought to surface 108. In examples, information handling system 138 may communicate with bottom hole assembly 130 through a communication line (not illustrated) disposed in (or on) drill string 116. In examples, wireless communication may be used to transmit information back and forth between information handling system 138 and bottom hole assembly 130. Information handling system 138 may transmit information to bottom hole assembly 130 and may receive as well as process information recorded by bottom hole assembly 130. In examples, a downhole information handling system (not illustrated) may comprise, without limitation, a microprocessor or other suitable circuitry, for estimating, receiving, and processing signals from bottom hole assembly 130. Downhole information handling system (not illustrated) may further comprise additional components, such as memory, input/output devices, interfaces, and the like. In examples, while not illustrated, bottom hole assembly 130 may comprise one or more additional components, such as analog-to-digital converter, filter, and amplifier, among others, that may be used to process the measurements of bottom hole assembly 130 before they may be transmitted to surface 108. Alternatively, raw measurements from bottom hole assembly 130 may be transmitted to surface 108.

Any suitable technique may be used for transmitting signals from bottom hole assembly 130 to surface 108, including, but not limited to, wired pipe telemetry, mud-pulse telemetry, acoustic telemetry, and electromagnetic telemetry. While not illustrated, bottom hole assembly 130 may comprise a telemetry subassembly that may transmit telemetry data to surface 108. At surface 108, pressure sensors (not shown) may convert the pressure signal into electrical signals for a digitizer (not illustrated). The digitizer may supply a digital form of the telemetry signals to information handling system 138 via a communication link 140, which may be a wired or wireless link. The telemetry data may be analyzed and processed by information handling system 138. In some examples, information handling system 138 may be configured to update a hybrid data generator to generate an updated drilling program based on the measurements gathered from the various sensors disposed on the drilling equipment. In some examples, threshold values set for various drilling parameters, engineering parameters, operational parameters, and/or fluid parameters, which may be measured by any one or more of the sensors disposed within the drilling operation, may trigger the hybrid data generator to generate an updated drilling program. In further examples, the information handling system may be configured to update the hybrid data generator such that the drilling program is updated continuously, at set intervals, at random intervals, by manual execution as determined by personnel, when a threshold is met for any one or more parameters as described above, or combinations thereof. In some examples, manual input may be provided which may be utilized to update the hybrid data generator. In further examples the updated drilling program may be automatically implemented or may be reviewed and approved by personnel prior to implementation.

As illustrated, communication link 140 (which may be wired or wireless, for example) may be provided that may transmit data from bottom hole assembly 130 to an information handling system 138 at surface 108. Information handling system 138 may comprise a personal computer 142, a video display 144, input device 146 (e.g., keyboard, mouse, etc.), and/or non-transitory machine-readable media 148 (e.g., optical disks, magnetic disks) that may store code representative of the methods described herein. In addition to, or in place of processing at surface 108, processing may occur downhole. As will be discussed below, the hybrid data generator may be executed on information handling system 138, both before drilling operations commence, while drilling operations are occurring, or during periods where drilling operations are stalled, to generate an initial and/or an updated drilling program.

Information handling system 138 may comprise any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 138 may be a personal computer, a network storage device, or any other suitable device and may vary in size, shape, performance, functionality, and price. Information handling system 138 may comprise random access memory (RAM), one or more processing resources such as a central processing unit (CPU) or hardware or software control logic, ROM, and/or other types of nonvolatile memory. Additional components of the information handling system 138 may comprise non-transitory machine-readable media 148 (e.g., one or more disk drives), output devices, such as a video display 144, and one or more network ports for communication with external devices as well as an input device 146 (e.g., keyboard, mouse, etc.). Information handling system 138 may also comprise one or more buses operable to transmit communications between the various hardware components.

Alternatively, systems and methods of the present disclosure may be implemented, at least in part, with non-transitory machine-readable media. Non-transitory machine-readable media may comprise any instrumentality or aggregation of instrumentalities that may retain data and/or instructions for a period of time. Non-transitory machine-readable media may comprise, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
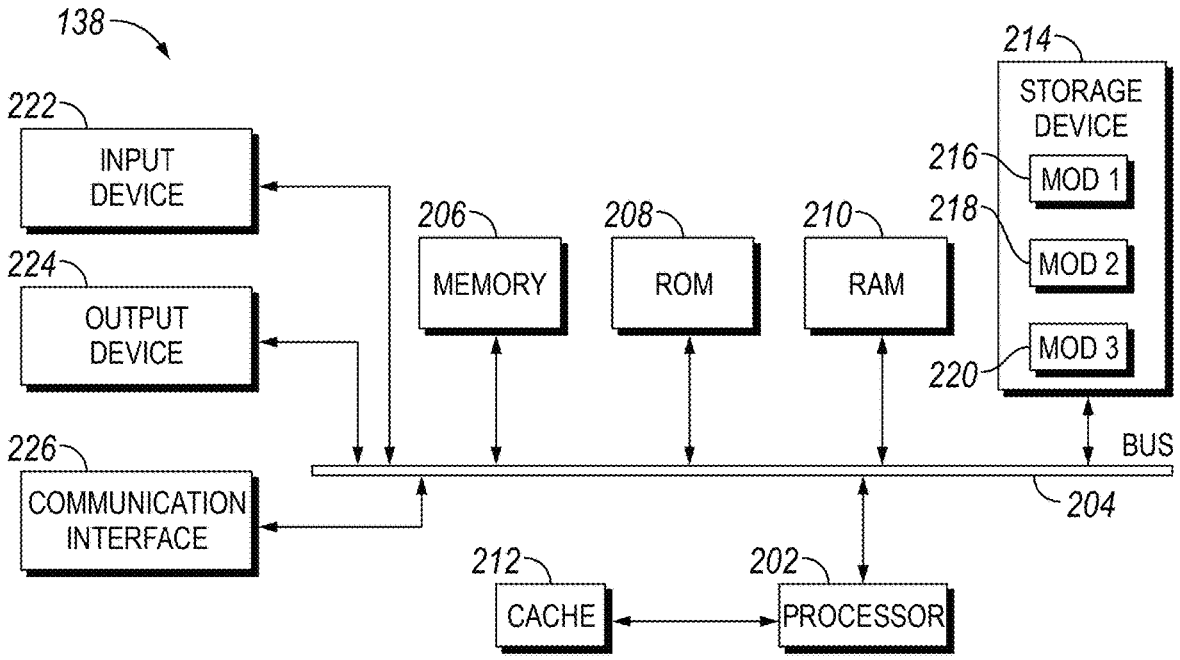
FIG. 2 illustrates is a schematic view of an information handling system.

FIG. 2 illustrates an example information handling system 138 which may be employed to perform various steps, methods, and techniques disclosed herein. Persons of ordinary skill in the art will readily appreciate that other system examples are possible. As illustrated, information handling system 138 comprises a processing unit (CPU or processor) 202 and a system bus 204 that couples various system components including system memory 206 such as read only memory (ROM) 208 and random-access memory (RAM) 210 to processor 202. Processors disclosed herein may all be forms of this processor 202. Information handling system 138 may comprise a cache 212 of high-speed memory connected directly with, in close proximity to, or integrated as part of processor 202. Information handling system 138 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may comprise multiple different types of memory with different performance characteristics. It may be appreciated that the disclosure may operate on information handling system 138 with more than one processor 202 or on a group or cluster of computing devices networked together to provide greater processing capability. Processor 202 may comprise any general-purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may comprise multiple processors, such as a system having multiple physically separate processors in different sockets, or a system having multiple processor cores on a single physical chip. Similarly, processor 202 may comprise multiple distributed processors located in multiple separate computing devices but working together such as via a communications network. Multiple processors or processor cores may share resources such as memory 206 or cache 212 or may operate using independent resources. Processor 202 may comprise one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 138, such as during start-up. Information handling system 138 further comprises storage devices 214 or machine-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may comprise software modules 216, 218, and 220 for controlling processor 202. Information handling system 138 may comprise other hardware or software modules. Storage device 214 is connected to the system bus 204 by a drive interface. The drives and the associated machine-readable storage devices provide non-volatile storage of machine-readable instructions, data structures, program modules and other data for information handling system 138. In one aspect, a hardware module that performs a particular function comprises the software component stored in a tangible machine-readable storage device in connection with the necessary hardware components, such as processor 202, system bus 204, and so forth, to carry out a particular function. In another aspect, the system may use a processor and machine-readable storage device to store instructions which, when executed by the processor, cause the processor to perform operations, a method or other specific actions. For example, the hybrid data generator, which may comprise a Large Language Model or other models derived from machine learning- and deep learning algorithms, may comprise computational instructions which may be executed on a processor to generate an initial and/or an updated drilling program. In some examples, the deep learning algorithms may comprise convolutional neural networks, long short term memory networks, recurrent neural networks, generative adversarial networks, attention neural networks, zero-shot models, fine-tuned models, domain-specific models, multi-modal models, transformer architectures, radial basis function networks, multilayer perceptrons, self-organizing maps, deep belief networks, and combinations thereof. The basic components and appropriate variations may be modified depending on the type of device, such as whether information handling system 138 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 138 employs storage device 214, which may be a hard disk or other types of machine-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible machine-readable storage media, machine-readable storage devices, or machine-readable memory devices, expressly exclude media such as transitory waves, energy, carrier signals, electromagnetic waves, and signals per se.

To enable user interaction with information handling system 138, an input device 222 represents any number of input mechanisms, such as a microphone for speech, a touch-sensitive screen for gesture or graphical input, keyboard, mouse, motion input, speech and so forth. An output device 224 may also be one or more of a number of output mechanisms known to those of skill in the art. In some instances, multimodal systems enable a user to provide multiple types of input to communicate with information handling system 138. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general-purpose processor. For example, the functions of one or more processors presented in FIG. 2 may be provided by a single shared processor or multiple processors. (Use of the term "processor" should not be construed to refer exclusively to hardware capable of executing software.) Illustrative examples may comprise microprocessor and/or digital signal processor (DSP) hardware, read-only memory (ROM) 208 for storing software performing the operations described below, and random-access memory (RAM) 210 for storing results. Very large-scale integration (VLSI) hardware examples, as well as custom VLSI circuitry in combination with a general-purpose DSP circuit, may also be provided.

Figure 3:
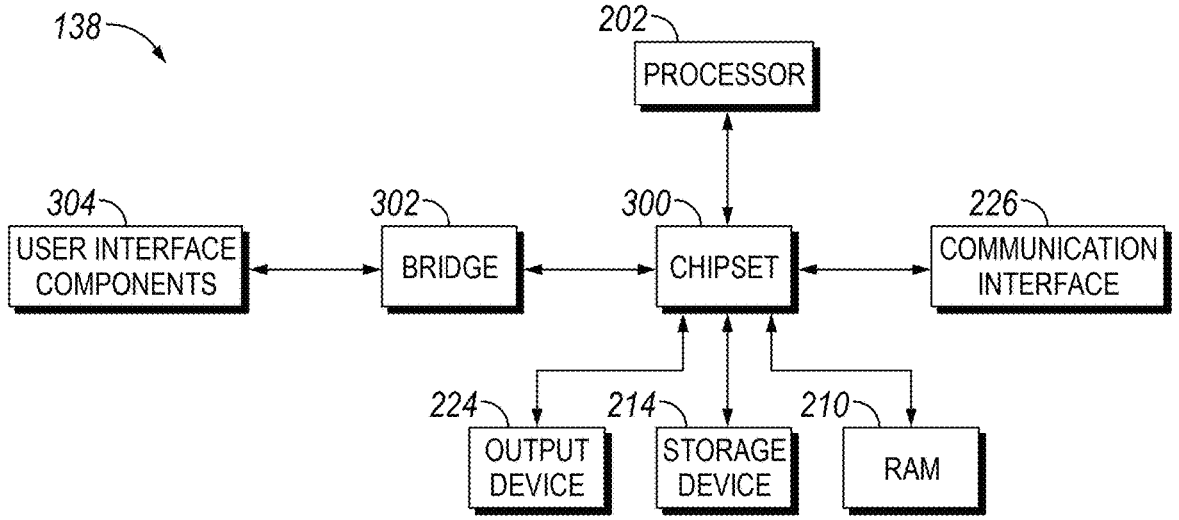
FIG. 3 illustrates another schematic view of and information handling system.

FIG. 3 illustrates an example information handling system 138 having a chipset architecture that may be used in executing the described method and generating and displaying a graphical user interface (GUI). Information handling system 138 is an example of computer hardware, software, and firmware that may be used to implement the disclosed technology. Information handling system 138 may comprise a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may comprise, for example, magnetic media, and solid-state media. Chipset 300 may also read data from and write data to RAM 210. A bridge 302 for interfacing with a variety of user interface components 304 may be provided for interfacing with chipset 300. Such user interface components 304 may comprise a keyboard, a microphone, touch detection and processing circuitry, a pointing device, such as a mouse, and so on. In general, inputs to information handling system 138 may come from any of a variety of sources including machine generated and/or human generated.

Chipset 300 may also interface with one or more communication interfaces 226 that may have different physical interfaces. Such communication interfaces may comprise interfaces for wired and wireless local area networks, for broadband wireless networks, as well as personal area networks. Some applications of the methods for generating, displaying, and using the GUI disclosed herein may comprise receiving ordered datasets over the physical interface or be generated by the machine itself by processor 202 analyzing data stored in storage device 214 or RAM 210. Further, information handling system 138 may receive one or more inputs from a user via user interface components 304 and execute appropriate functions, such as browsing functions by interpreting these inputs using processor 202.

In examples, information handling system 138 may also comprise tangible and/or non-transitory machine-readable storage devices for carrying or having machine-executable instructions or data structures stored thereon. Such tangible machine-readable storage devices may be any available device that may be accessed by a general purpose or special purpose computer, including the functional design of any special purpose processor as described above. By way of example, and not limitation, such tangible machine-readable devices may comprise RAM, ROM, EEPROM, CD-ROM or other optical disk storage, magnetic disk storage or other magnetic storage devices, or any other device which may be used to carry or store desired program code in the form of machine-executable instructions, data structures, or processor chip design. When information or instructions are provided via a network, or another communications connection (either hardwired, wireless, or combination thereof), to a computer, the computer properly views the connection as a machine-readable medium. Thus, any such connection is properly termed a machine-readable medium. Combinations of the above should also be comprised within the scope of the machine-readable storage devices.

Machine-executable instructions comprise, for example, instructions and data which cause a general-purpose computer, special purpose computer, or special purpose processing device to perform a certain function or group of functions. Machine-executable instructions also comprise program modules that are executed by computers in standalone or network environments. Generally, program modules comprise routines, programs, components, data structures, objects, and the functions inherent in the design of special-purpose processors, etc. that perform particular tasks or implement particular abstract data types. Machine-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

During drilling operations, information handling system 138 may process different types of real time data originated from varied sampling rates and various sources, such as diagnostics data, sensor measurements, operations data, and/or the like. These one or more measurements from wellbore 102, BHA 130, measurement assembly 134, and one or more sensors 136 may allow for information handling system 138 to perform real-time health assessment of the drilling operation. In some examples, the foregoing one or more measurements may be utilized to generate an updated drilling program when the one or more measurements are supplied to the hybrid data generator. Drilling tools and equipment may further comprise a variety of sensors which may be able to provide one or more real-time measurements and data relevant to steering the wellbore in adherence to a well plan. In some examples this drilling equipment may comprise drilling rigs, top drives, drilling tubulars, mud motors, gyroscopes, accelerometers, magnetometers, bent housing subs, directional steering heads, rotary steerable systems ("RSS"), whipstocks, push-the-bit systems, point-the-bit systems, and other directional drilling tools. In the context of drilling operations, "real-time," may be construed as monitoring, gathering, assessing, and/or utilizing data contemporaneously with the execution of the drilling operation. Real-time operations may further comprise modifying the initial design or execution of the planned operation in order to modify a well plan of a drilling operation. In some examples, the modifications to the drilling operation may occur through automated or semi-automated processes. An example of an automated drilling process may comprise relaying or downlinking a set of operational commands (control commands) to an RSS in order to modify a drilling operation to achieve a certain objective. In other examples, operational commands (control commands), which may be derived from an initial or an updated drilling program may be automatically relayed to the top drive. In other examples, the operational commands (control commands) may be relayed to the rig personnel for review prior to implementation. In some examples, one or more drilling objectives and operational features may be incorporated into the drilling operation through the utilization of a cost function. In further examples, the cost function may be optimized for one or more operational features including but not limited to maximizing rate of penetration, maximizing hole cleaning, maximizing hole stability, operational safety, minimizing total drilling cost, minimizing operational time per hole section, minimizing cost per hole section, and combinations thereof.

Figure 4:
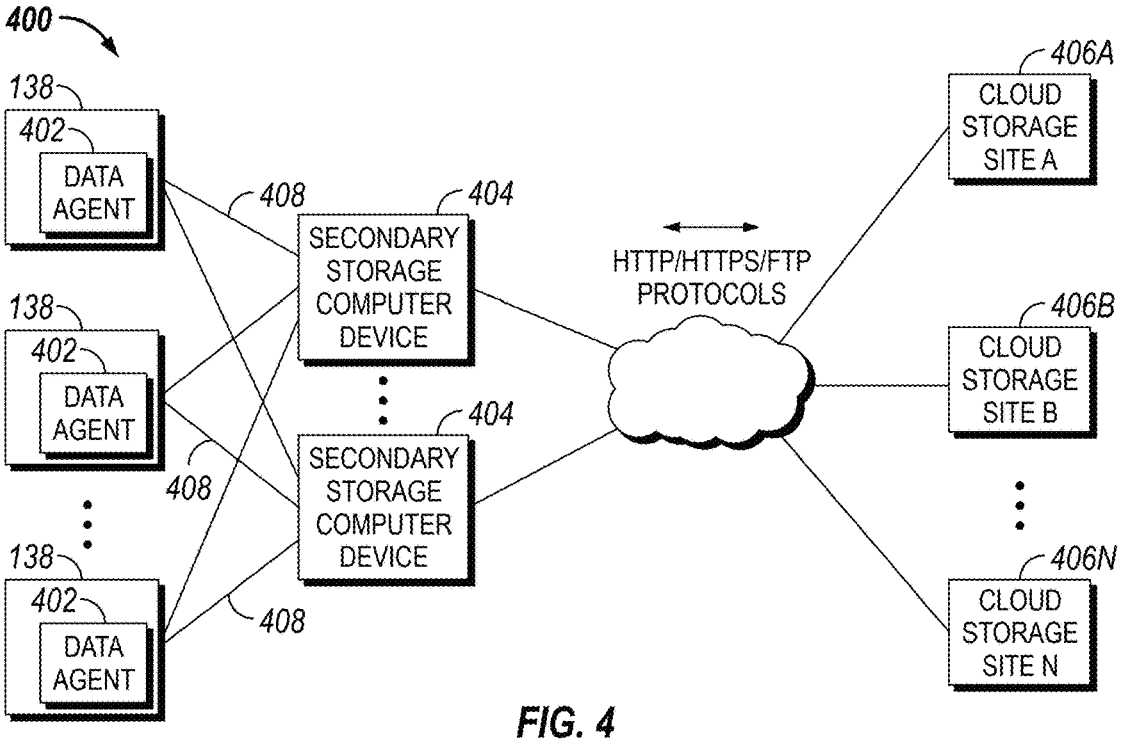
FIG. 4 illustrates a schematic view of a network.

FIG. 4 illustrates an example of one arrangement of resources in a computing network 400 that may employ the processes and techniques described herein, although many others are of course possible. As noted above, an information handling system 138, as part of their function, may utilize data, which comprises files, directories, metadata (e.g., access control list (ACLS) creation/edit dates associated with the data, etc.), and other data objects. The data on the information handling system 138 is typically a primary copy (e.g., a production copy). During a copy, backup, archive or other storage operation, information handling system 138 may send a copy of some data objects (or some components thereof) to a secondary storage computing device 404 by utilizing one or more data agents 402.

A data agent 402 may be a desktop application, website application, or any software-based application that is run on information handling system 138. As illustrated, information handling system 138 may be disposed at any rig site (e.g., referring to FIG. 1) or repair and manufacturing center. The data agent may communicate with a secondary storage computing device 404 using communication protocol 408 in a wired or wireless system. The communication protocol 408 may function and operate as an input to a website application. In the website application, field data related to pre- and post-operations, generated DTCs, notes, and the like may be uploaded. Additionally, information handling system 138 may utilize communication protocol 408 to access processed measurements, operations with similar DTCs, troubleshooting findings, historical run data, and/or the like. This information is accessed from secondary storage computing device 404 by data agent 402, which is loaded on information handling system 138.

Secondary storage computing device 404 may operate and function to create secondary copies of primary data objects (or some components thereof) in various cloud storage sites 406A-N. Additionally, secondary storage computing device 404 may run determinative algorithms on data uploaded from one or more information handling systems 138, discussed further below. Communications between the secondary storage computing devices 404 and cloud storage sites 406A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 406A-N, the secondary storage computing device 404 may also perform local content indexing and/or local object-level, sub-object-level or block-level deduplication when performing storage operations involving various cloud storage sites 406A-N. Cloud storage sites 406A-N may further record and maintain DTC code logs for each downhole operation or run, map DTC codes, store repair and maintenance data, store operational data, and/or provide outputs from determinative algorithms and or models that are located in cloud storage sites 406A-N. In a non-limiting example, this type of network may be utilized as a platform to store, backup, analyze, import, and perform extract, transform and load ("ETL") processes to the data gathered during a drilling operation. In further examples, this type of network may be utilized to execute a hybrid data generator to generate an initial and/or an updated drilling program.

As discussed below, methods may be utilized by and/or performed on information handling system 138 for real-time calibration of tool yield in steering system during directional drilling. Specifically, the real-time calibration of mud motors or RSS to steer BHA 130 within a subterranean formation 106. As disclosed here, mud motors and/or RSS may be defined as a steering sub. These methods leverage various mathematical and statistical techniques to refine and optimize the system's performance based on real-time data. Bayesian statistical methods, offers certain advantages over alternative methods for real-time calibration, particularly in the context of uncertainty quantification and statistical modeling of tool yield during the drilling process. Markov Chain Monte Carlo (MCMC) is a powerful method within the Bayesian statistical framework with its efficiency in exploration of the parameter space and adaptability to the intricacies of real-world systems. Nevertheless, conventional MCMC methods encounter difficulties in handling real-time data from mud motors, owing to the inherent characteristics of the data and the complexity of the parameter space.

For example, the steerability of a mud motor in directional drilling is achieved by alternating between a "rotate" mode and a "slide" mode, discussed below. Consequently, the streaming directional data of mud motor exhibits a segmented structure, reflecting the distinct modes of operation during sliding and rotating phases. The unique segmented nature of this data poses challenges for conventional calibration algorithms. In response, the proposed calibration approach, leveraging Reversible Jump Markov Chain Monte Carlo (RJMCMC), stands out as a robust solution. Since the number and the position of the segments are unknown, RJMCMC becomes a very suitable method since it may handle changes in the model dimension. The proposed calibration method is also able to handle mode transitions, manage sparse data, and deal with model complexity. This comprehensive approach may allow for precisely calibrating the mud motor's steerability in directional drilling operations.

The method leverages Bayesian statistical framework, specifically reversible jump Markov Chain Monte Carlo (RJMCMC), to generate posterior distribution of steering parameters based on real-time directional data. The objective of calibration in directional drilling is to determine the assumed system dynamics or functional relationship between the steering inputs (such as toolface and steering ratio measurements) and their corresponding responses, given noisy real-time measurement. Taking inclination as an illustrative example, the system dynamics for a mud motor may be represented as follows:

$$\dot{\theta} = K_{slide} \cdot u \cdot DC + K_{rotate} \cdot (1 - DC) \tag{1}$$

where u represents the steering input, specifically the toolface measurement for the mud motor. DC corresponds to the duty cycle, where a value of 1 indicates the slide mode and 0 denotes the rotate mode. The parameters $K_{slide}$ and $K_{rotate}$ are essential calibration parameters, and their values are calibrated based on real-time data.

Figure 5:
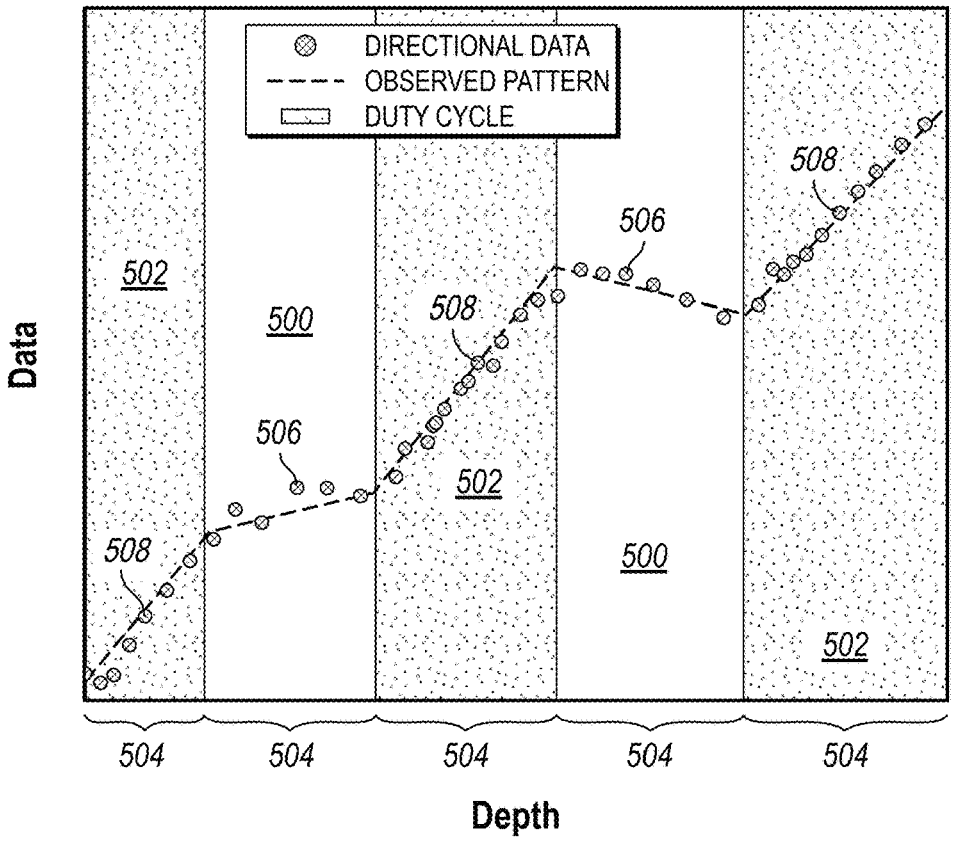
FIG. 5 illustrates a graph of real-time inclination data comprising a series of continuous measurements that alternate between "slide" and "rotate" modes.

The real-time inclination data comprises a series of continuous measurements that alternate between "slide" mode 502 and "rotate" mode 500, is illustrated in a graph in FIG. 5. It should be noted that each "mode" may direct RSS of BHA 130 (e.g., referring to FIG. 1) to either slide or rotate. Further each "mode" may be utilized in mud motor drilling, where each "mode" may direct a mud motor to slide (build a curve) or rotate (drill a tangent) to follow a well plan. The distance to slide/rotate is determined if you know the tool yield in the two modes which depends on bit/rock interaction, disclosed herein. This dataset exhibits a segmented structure with continuous data transitioning between these distinct operational modes. For example, slide mode 502 and rotate mode 500 may each have a distinct segment length 504. Segment length 504 is a set length of time in which the mud motor may operate in either slide mode 502 or rotate mode 500. In slide mode 502, drill bit 122 may be rotating without rotation of drill string 116, which may form wellbore 102 in a desired direction by utilizing the bend near drill bit 122 to direct drill bit 122 (e.g., referring to FIG. 1) to a different direction from the axis of wellbore 102. In rotate mode 500, as a planed angle is achieved, where the planed angle is a pre-determined path for which wellbore 102 may be intended to go during drilling operation, drill string 116 may rotate to speed up drilling and continue drilling operations in the same direction. During these segment lengths 504, one or more sensors 136 (e.g., referring to FIG. 1) may take one or more directional data measurements 506. Directional data measurements 506 may comprise position, orientation, weight-on-bit, strains, movements, wellbore diameter, resistivity, drilling tool orientation, which may be specified in terms of a tool face angle (rotational orientation), and inclination angle (the slope), and compass direction. An observed pattern 508 may be found form directional data measurements 506 as illustrated in the graph of FIG. 5.

As illustrated in FIG. 5, the alternating nature of modes introduces challenges in precisely identifying segment boundaries and executing segment-specific regression to capture the dynamic behavior within each model. for example, dynamic behavior measured may be how curvature, inclination, and azimuth may change in each rotate mode 500 and/or slide mode 502. The dataset's inherent characteristics highlight the necessity for specialized modeling techniques adept at accommodating the discontinuities inherent in mode transitions.

Assuming the continuous data may be regressed by a standard polynomial regression model, where the number and position of the segments are parameters to be estimated. The model may be formulated as follows:

$$Y = f(\theta_1, x) + \sum_{i=1}^{k} f(\theta_i^n, x - \tau_i) \tag{2}$$

where k denotes the number of the segments, $\tau_i$ and $\theta_i^n$ represent the location and the regression parameter of the ith segment, respectively. The parameter n is the order of polynomial regression model, set to 1 for a linear model in the following discussion.

In order to get the posterior distribution of these parameters, Bayesian approaches are used. Solving the segment-wise polynomial regression problem using a Bayesian framework involves specifying a probabilistic model that captures the uncertainty in the parameters and allows for the incorporation of prior knowledge. In that case, given the prior distribution of the model parameters P(θ) and observed dataset D, the posterior distribution P(θ|D) may be derived from:

$$P(\theta \mid D) = \frac{P(D \mid \theta) \cdot P(\theta)}{P(D)} \tag{3}$$

where P(θ|D) is the likelihood, representing the probability of observing the data given the model parameters. P(D) is the marginal likelihood by integrating the product of the likelihood and prior over the parameter space. The definition of the P(θ) may comprise of several priors which embed the various separate models within one large hierarchical mixture mode.

Figure 6:
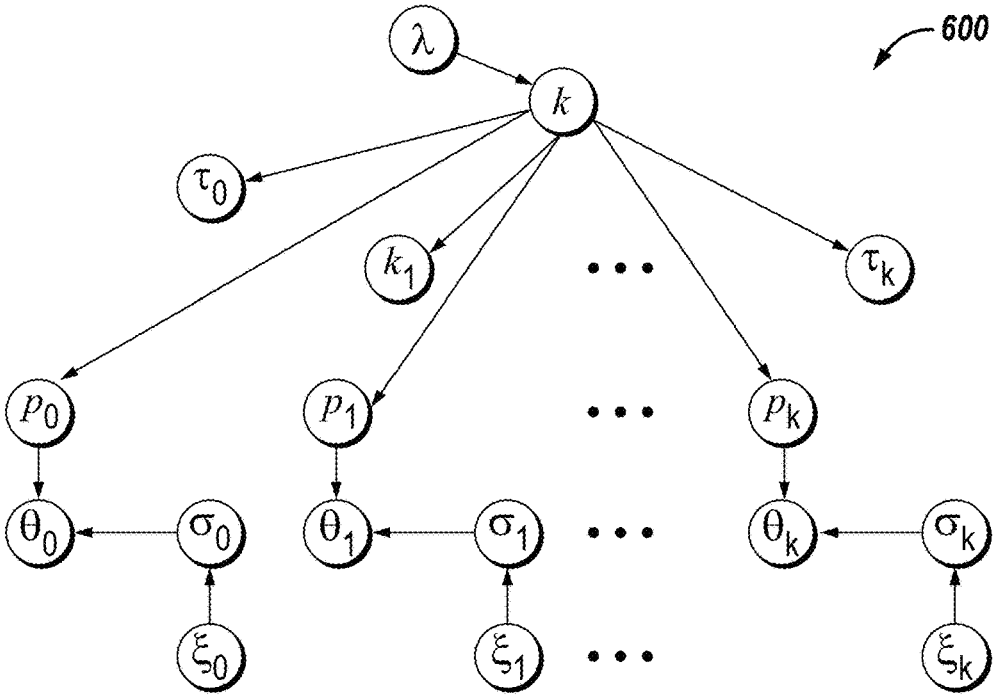
FIG. 6 illustrates a hierarchical structure of a directed acyclic graph model comprising multiple levels of various separate modelling parameters.

FIG. 6 illustrates a hierarchical structure of a directed acyclic graph model 600 comprising multiple levels of various separate modelling parameters. Directed acyclic graph model 600 may allow for decomposing the prior distribution of the model into multiple levels or layers, each level representing different layers of uncertainty for the modelling parameters. The hierarchical model may be simplified as:

$$\mathcal{M} \triangleq (k, \tau, p, \theta, \sigma) \tag{4}$$

In this model, the unknown model parameters are the number of segments (k), their locations (τ), the orders and parameters of regression model for each segment (p,θ respectively) and the noise level of the dataset (σ). Certain distributions may be assumed for each model parameter to account for the uncertainties. For convenience of discussion, a uniform distribution may be used for the number of segments k and correspondingly, a binomial distribution is assumed for the location of each segment t with a parameter of λ. Similarly, a uniform distribution may also be assumed for the order of the regression model for each segment. The regression parameters are assumed to follow normal distribution $\mathcal{N}(0,\sigma^2)$ with a normal distribution of $\mathcal{N}(\theta,\xi^2)$ to the noise variances. Thus, the hierarchical probability for the prior of the parameters may be expressed as:

$$p(k, \lambda, p, \theta, \xi) = p(\lambda)p(p)p(\theta_k, \sigma_k^2, \xi_k) = p(\lambda)p(k, \tau_k \mid \lambda) \prod_{i=0}^{k} [p(p_i)] \prod_{i=0}^{k} [p(\theta_i \mid \sigma_i^2)p(\sigma_i^2 \mid \xi_i)]\, p(\xi_i) \tag{5}$$

where $p(k,\tau_k|\lambda)=\lambda^k(1-\lambda)^{n-2-k}[\![\gamma_k(\tau_k)]\!]$, $0<\lambda<1$, where $\gamma_k \triangleq \{\tau_{1:k} \in \{1, \ldots, n-2\}^k$ and $[\![\gamma_k(\tau_k)]\!]$ is indicator function of the set $\gamma_k$ (1 if $\tau_k \in \gamma_k$, 0 otherwise).

Assuming all noises follow independently and identically distributed Gaussian, the likelihood function takes the form:

$$p(D \mid k, \lambda, p, \theta, \xi) = \prod_{i=0}^{k} (2\pi\sigma_i^2)^{-((\tau_{i+1}-\tau_i)/2)} \exp\left(-\frac{1}{2\sigma^2}(y_i - f(x_i))^2\right) \tag{6}$$

where $y_i$ is the observation data from data space D, and $f(x_i)$ is the calculated results using the regression parameters for each segment. The posterior distribution may be obtained using Bayes' theorem as:

$$p(k, \lambda, p, \theta, \xi \mid D) \propto p(D \mid k, \lambda, p, \theta, \xi)p(k, \lambda, p, \theta, \xi) \quad (7)$$

It is not possible to obtain the analytical solution of the posterior distribution as high-dimensional integrals of non-linear functions may be calculated, as shown in the equations above. Thus, MCMC may be utilized, specifically RJMCMC (with more details in next section) to construct an ergodic Markov chain whose equilibrium distribution is the desired posterior distribution.

The formulated problem, while appearing deceptively simple in form, is inherently challenging. Its complexity lies in the estimation of both the number and position of the segments, making the model dimension variable. RJMCMC emerges as a powerful solution for such challenges, excelling in handling changes in model dimension and enabling exploration across diverse segment configurations.

In traditional MCMC, the Markov chain is built that the probabilities of transitioning between states are symmetric. Detailed balance ensures that if the chain may move from state A to B with certain probability, it may also move from state B to A with a corresponding probability. This property of ergodicity ensures the chain is able to explore the entire state space and converge to the desired stationary distribution. Mathematically, detailed balance ensures that the ratio of transition probabilities between two states (from state i to j) in the Markov chain is the same as the ratio of probabilities in the stationary distribution, as follows:

$$\pi_i P_{ij} = \pi_j P_{ji} \; \forall \, i, j \quad (8)$$

Based on the concept of detailed balancing, many MCMC algorithms, including Metropolis-Hastings (MH), are used to find the stationary distribution. Taking MH algorithm as an example, a Markov chain that converges to a stationary distribution is constructed by accepting or rejecting proposed move based on a certain probability. In a move from a current state i with state probability as $p_i$ to a proposed state j with state probability as $p_j$, governed by a transition probability which is denoted as q(i,j) and a probability of moving back from the proposed state to current state as q(j,i), an acceptance ratio, denoted as a and expressed as below, is used to decide whether to accept or reject the proposal.

$$\alpha(i, j) = \min\left\{\frac{p_j q(j, i)}{p_i q(i, j)}, 1\right\} \quad (9)$$

This assures that if $\alpha>1$, the proposed state is 100% accepted, and if $0<\alpha<1$, the proposed state will be accepted with a probability of $\alpha$. The proposed state will be rejected with probability of $1-\alpha$ if $\alpha$ falls beyond the range discussed. It may be assumed as a normal distribution of the proposal with center value at the previous state and constant variance which simplified the acceptance ratio via q(i,j)=q(j,i), making it as Metropolis algorithm, while the Metropolis-Hastings algorithm refer to more general transition distribution.

In the context of Bayesian statistics and RJMCMC, the algorithm is often used for model selection, allowing for changes in the dimensionality of the parameter space. It is necessary to adjust the prior probabilities and likelihoods for the different parameter spaces. In this scenario, Metropolis-Hastings proposal is utilized with an acceptance probability that is designed to preserve detailed balance within each move. In that sense, certain reversible moves are proposed to maintain the volume of the parameter space, ensuring that the proposal does not introduce any new scaling factors. In a move from model k with parameter $\theta_k$ to model k* with parameter $\theta_k$*. The 'dimension matching' may be achieved by introducing auxiliary variables u and u* from proposal distributions Q(u) and Q(u*), and then forming $\theta_k$ and $\theta_k$* with deterministic functions of $\theta_k=g(\theta_k^*,u^*)$ and $\theta_k^*=g(\theta_k, u)$, provided that dim $(\theta_k,u)=\dim(\theta_k^*,u^*)$. Then a Jacobian determinant of the proposed transformation is reflected in the acceptance ratio as follows to account for the change of the measure between $(\theta_k,u)$ and $(\theta_k^*,u^*)$:

$$\alpha(i, j) = \min\left\{\frac{p(k^*, \theta_k^*)\, q(k^*, k)\, Q(u^*)}{p(k, \theta_k)\, q(k, k^*)\, Q(u)} \left|\frac{\partial(\theta_k^*, u^*)}{\partial(\theta_k, u)}\right|, 1\right\} \quad (10)$$

Figure 7:
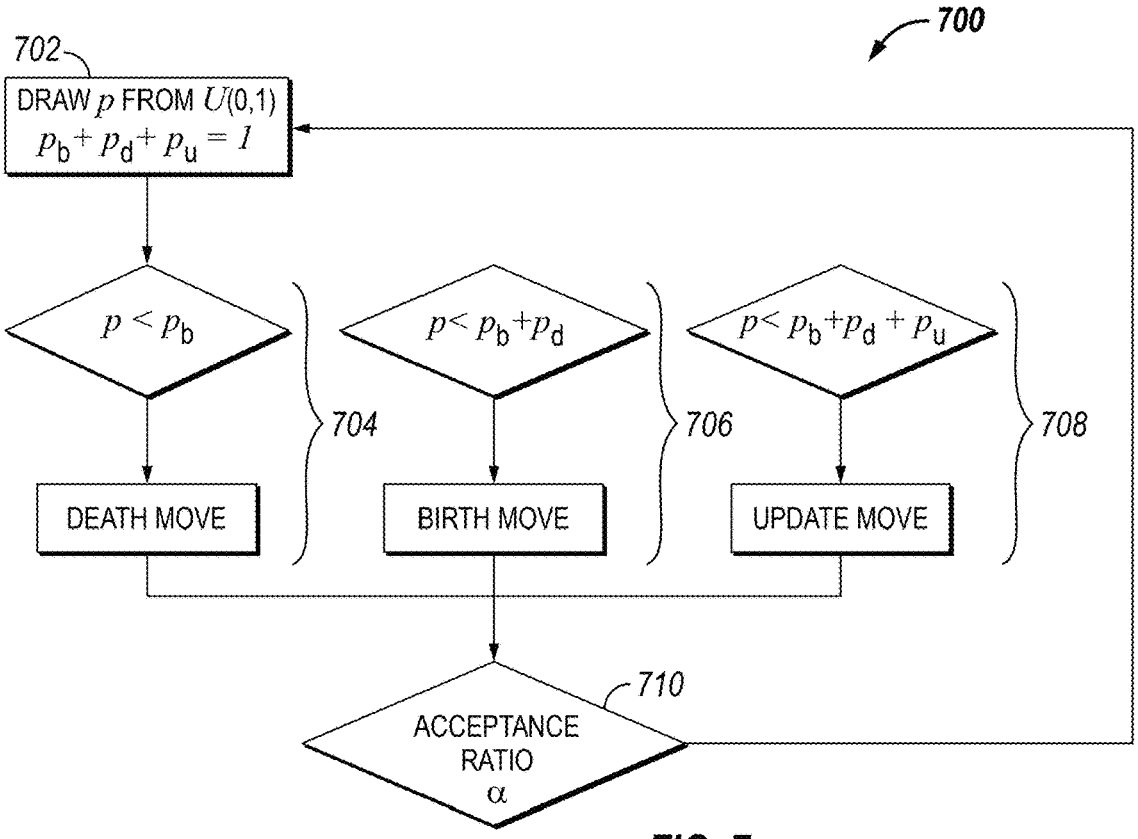
FIG. 7 illustrates a workflow for proposed moves using the RJMCMC method for calibration.

RJMCMC may simplify this acceptance ratio by constructing the move to set the model parameters of the proposed state identical to the auxiliary variable, which is $\theta_k=g(\theta_k^*, u^*)=u^*$ and $\theta_k^*=g(\theta_k,u)=u$. By setting it, the Jacobian term in the acceptance ratio becomes unity, making the computational more manageable. More specifically, three types of "moves," comprising birth, death, and update moves, may be introduced to navigate between different models, using RJMCMC discussed herein, with varying numbers of parameters while attempting to maintain the volume of the parameter space. For this disclosure, "moves" are the transitions between different models, which may have different numbers of parameters. Additionally, FIG. 7 illustrates a schematic view of a workflow 700 of proposed moves (which may also be referred to as perturbations) when using RJMCMC for calibration of mud motor steerability. This workflow may be performed at least in part on information handling system 138. As illustrated, three types of moves (perturbations), including birth, death, and update moves may be utilized. The birth move is adding a new parameter to the model, the death move is removing an existing parameter from the model, and the update move is changing from one model to another with a different structure. Taking the regression problem as an example, by using RJMCMC method, three basic possible steps: birth, death and update moves are defined below. The Markov chain iterates by choosing different types of moves (birth, death, or update) based on predefined probabilities. For each move, it proposes new parameters or models, calculates an acceptance probability, and then decides whether to accept or reject the move based on a random number. This process is repeated for many iterations to explore the model space effectively, allowing for Bayesian model selection and averaging. As illustrated, block 702 may begin workflow 700. In block 702, $\rho$ may be drawn from U(0,1) which may be represented as $p_b+p_d+p_u=1$. At each iteration, one of the moves described above may be randomly chosen with probabilities $p_b$(birth) 706, $p_d$(death) 704, and $p_u$(update) 708 such that $p_b+p_d+p_u=1$. Below is a detailed description of each move. When using $p_b$ 706 or $p_d$ 704, these moves may involve proposing a new change point at random $p_b$ 706 or removing an existing point chosen randomly with probability of $p_d$ 704. Additionally, a new state $\omega'=(k+1, \tau'_k)$ from $\omega=(k,\tau_k)$ with extra point $t\in[\tau_i+1, \tau_{i+1}-1]$, the acceptance ratio in block 710 was then expressed as:

$$\alpha(i, j) = \min\left\{\frac{p(k^*, \theta_k^*)\, q(k^*, k)}{p(k, \theta_k)\, q(k, k^*)}\, \frac{d_{k+1}}{b_k}, 1\right\} \tag{11}$$

The acceptance for birth move is $\alpha_b(i,j)=\min\{\alpha,1\}$, while for death move it is $\alpha_d(i,j)=\min\{\alpha^{-1},1\}$.

There are two scenarios for update moves in block 708. For update changepoints within the same segment, it is quite straightforward to change the changepoint. However, it is more complicated when the update occurs in different segments. In that case, it is described as the combination of two cases: removing an existing changepoints in one segment and proposing a new one in another segment. The acceptance ratio in block 710 becomes $\alpha_u(i,j)=\min\{\alpha_b^i\alpha_d^l,1\}$ where $i\neq l$. Workflow 700 may further be utilized in a calibration method for real-time directions measurements.

Figure 8:
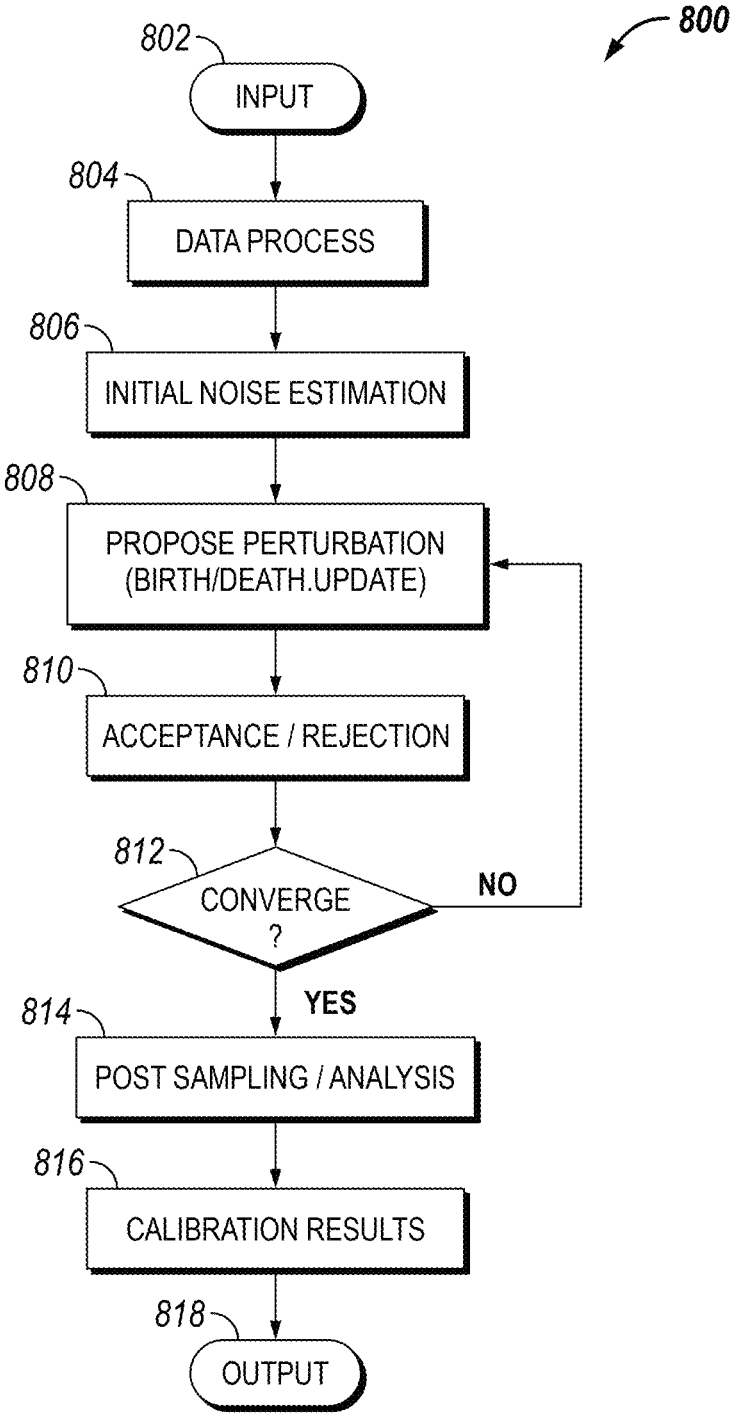
FIG. 8 illustrates a workflow for calibration of a mud motor.

FIG. 8 illustrates workflow 800 for implementing the proposed calibration method for real-time directional measurements. It should be noted that workflow 800 may at least in part be performed on information handling system 138. As illustrated, workflow 800 may begin in block 802. In block 802, raw directional data may be input into information handling system 138 at machine-readable instructions. The raw directional data may encompass real-time measurements of inclination and azimuth, as well as survey data. As disclosed above, raw directional data may be taken by one or more sensors 136 disposed on BHA 130 (e.g., referring to FIG. 1).

The raw directional data from block 802 may undergo, at least in part, data processing in block 804. In examples the raw directional data from block 802 may be assigned different weights to each data source based on significance where this significance may be pre-determined or may be calculated based on data quality of the source. For example, significance may be determined based on sensor source (located closer to drill bit 122) its noise levels or uncertainty (one sensor has more variance in data than other) and its bias as compared to actual survey data. There may be other criteria such as the mechanism of sensing and any post processing that may be built into it Additionally, the raw data may be pre-processed, which may comprise removal of duplicates, outliers, and smoothing techniques. After pre-processing in block 804, in block 806 an initial noise level (the amount of random variation or error that is present in the data) may be estimated from the data and utilize it as the initial noise estimation. Additionally, noise level may be recorded data compared to the survey or record. The variation of inclination and azimuth data cannot be sudden so any deviations around a central trendline may be classified as noise. Estimating noise in numerical data may be performed methods such as calculating standard deviation, analyzing residuals, computing signal-to-noise ratio, applying Fourier Transform, using moving averages, and/or measuring autocorrelation. After the preparation work from block 804 to block 806, in block 808 a new state for the regression model may be proposed, achieved through death/birth moves or updates to changepoints, as described above.

In block 810 the acceptance ratio, described above in workflow 700, may be calculated using at least in part the raw data from block 808 to determine whether to accept or reject the proposed states. Further, in block 810 an iteration may be performed using raw data from block 808 for a predefined number of iterations as described above in workflow 700. In block 812, during the iteration process if a convergence is achieved the workflow 800 may move forward to block 814. However, if convergence is not found, then workflow 800 may be repeated at block 808 with selecting a new model and/or new data to find convergence in block 812. In block 814 samples, a random point may be randomly selected samples from a data set created from blocks 802-806 to determine a distribution at least in part, may be collected from the Markov Chain after a sufficient number of iterations. Additionally, in block 816 the posterior distribution of the regression parameters and generate calibration results may be estimated. For example, once you have the regression parameters from the converged model, a number and position of the segments may be identified. From these, the tool capability for slide and rotate modes may be estimated. Calibration results may be displayed as an output in block 818 as tool yield for slide mode 502 and rotate mode 500 (e.g., referring to FIG. 2). The distance to slide/rotate is determined if you know the tool yield in the two modes which depends on bit/rock interaction. The tool yield may be utilized to decide on where and how much to rotate and slide BHA 130 (e.g. referring to FIG. 1), using an RSS or mud motor, to achieve the tracking of a predetermined well plan. For example, when utilizing an RSS, RSS at 30% side-force may estimate tool yield and then utilizing an actuation at 50% then a tool yield may be found. Thus, a list of actuations vs tool yield may be produced and cataloged. The tool yield results, which may be cataloged, may be reviewed for an actuation of RSS or mud motor for a desired tool yield to match the well plan.

Figure 9A:
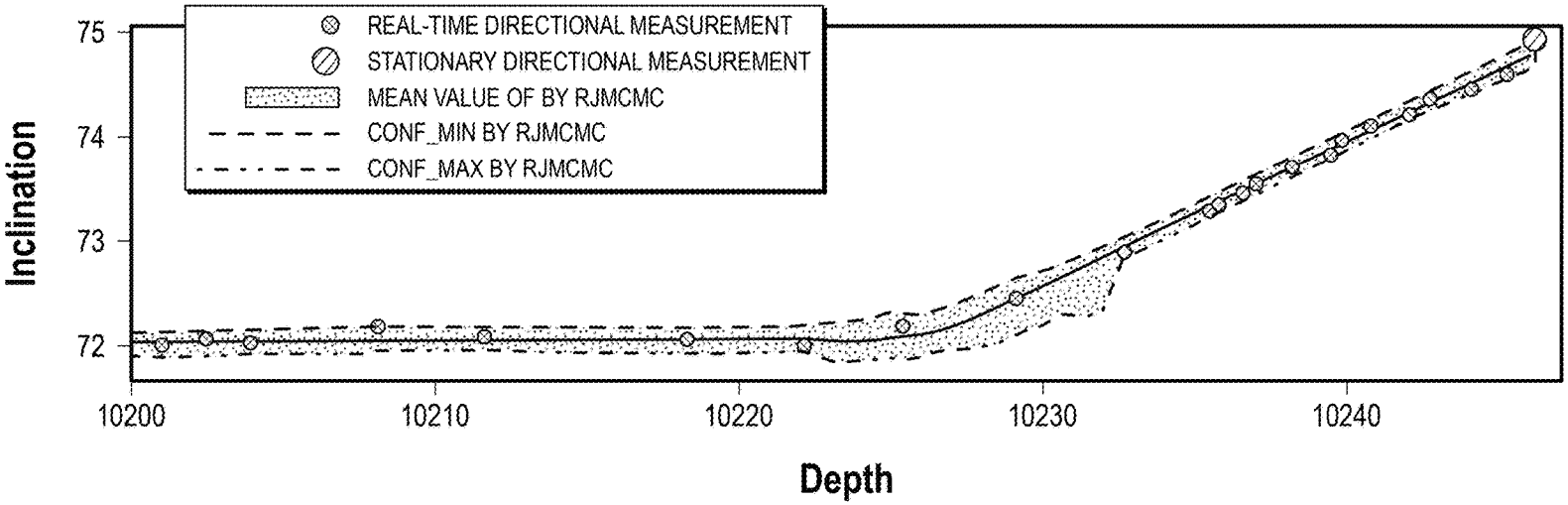
FIGS. 9A-9C are graphs showing results of 2-segment scenario using describe workflow.
Figure 9B:
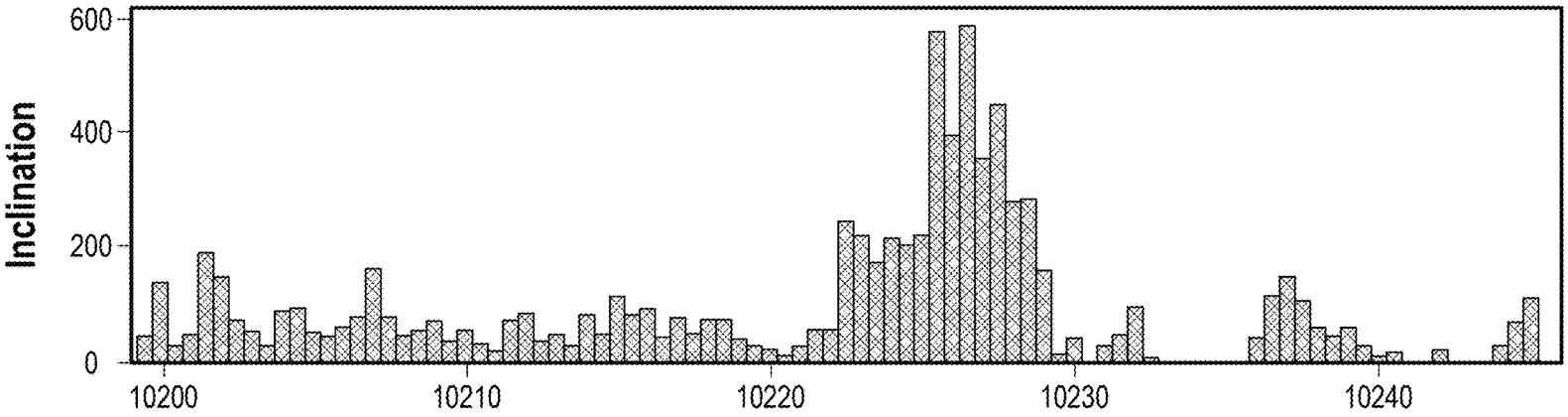
Figure 9C:
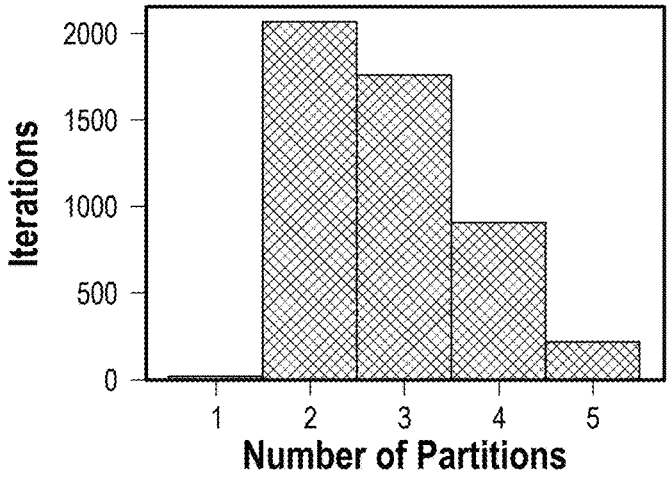
Figure 10A:
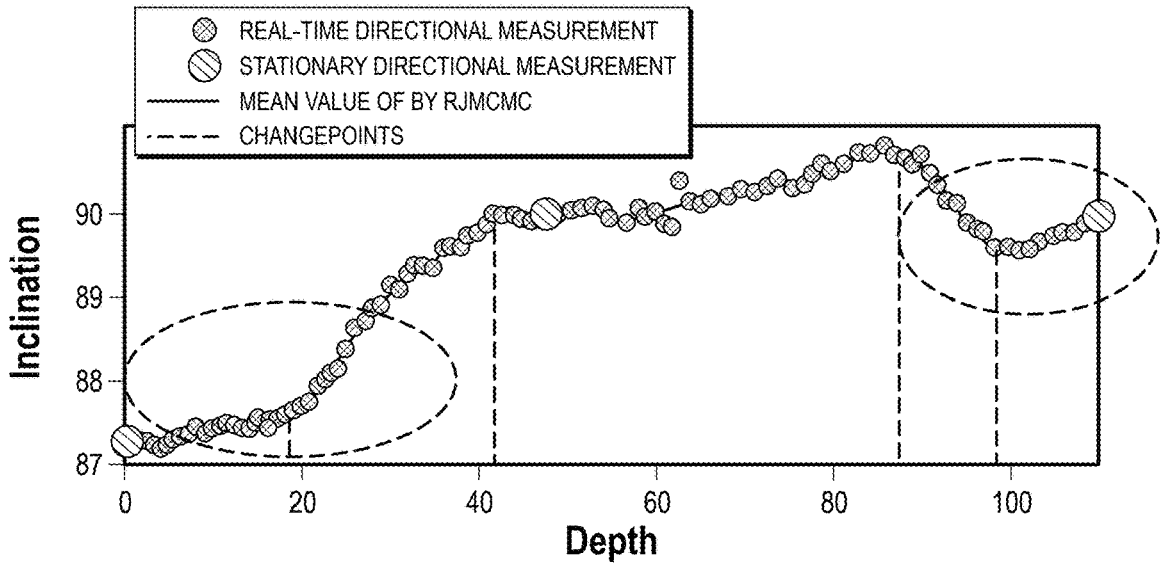
FIG. 10A-10D are graphs showing results of 5-segment scenario using describe workflow.
Figure 10B:
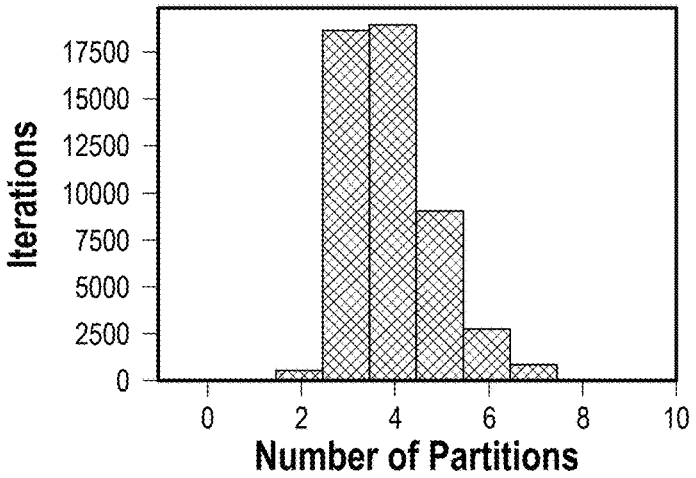
Figure 10C:
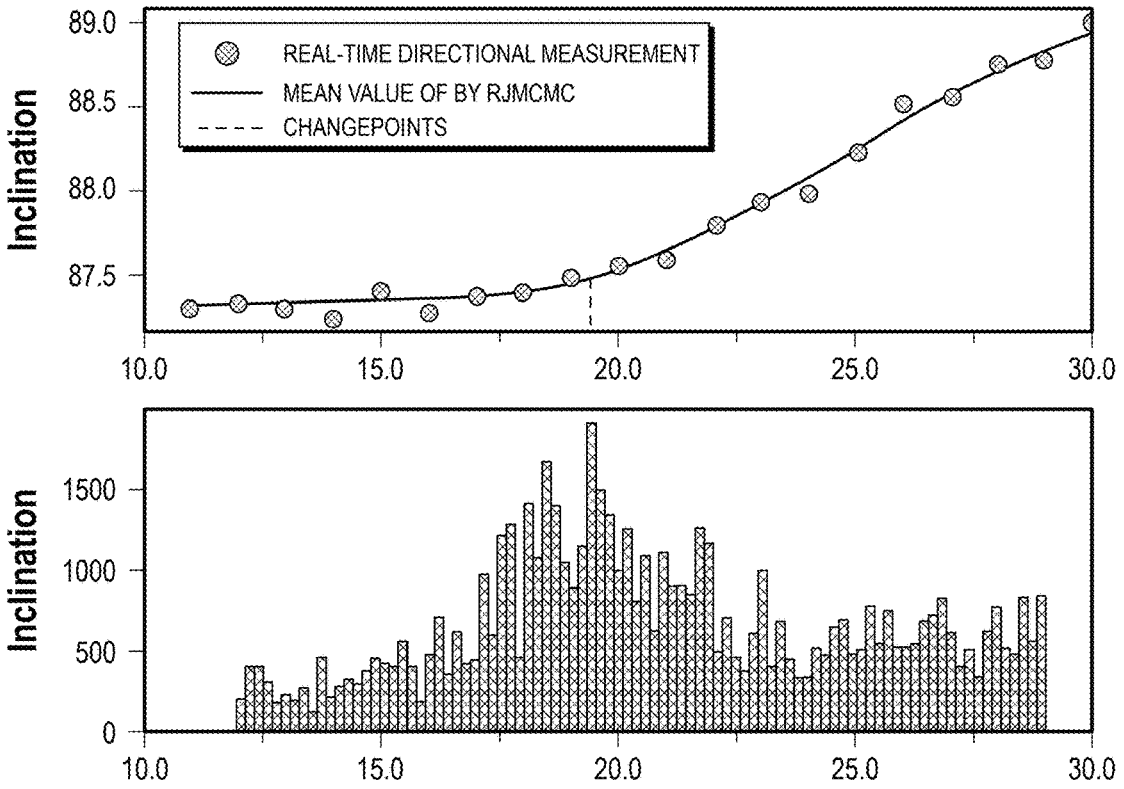
Figure 10D:
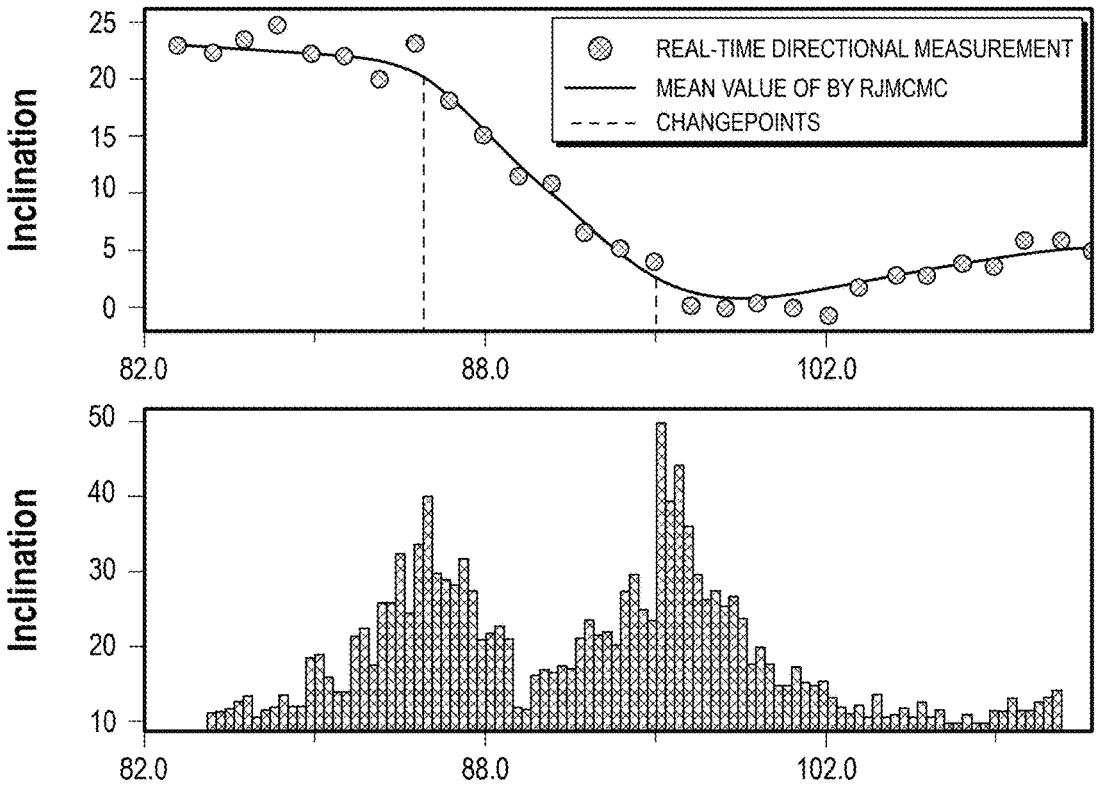

Utilizing the RJMCMC method may allow for the posterior distribution of model parameters to be derived. Results from a simulation employing the proposed methodology are depicted in FIGS. 9A-9C and FIGS. 10A-10D. In FIGS. 9A-9C, a representative scenario with only two segments is presented. From the computed results, using workflow 700 and 800 (i.e., referring to FIGS. 7 and 8), FIG. 9A displays the mean value alongside the predefined 95% confidence level. FIGS. 9B and 9C showcase the histogram detailing the distribution of locations and the count of changepoints, respectively. FIGS. 10A-10D illustrate a more intricate case involving five segments, as depicted in FIG. 10A. The histogram in FIG. 10B provides insight into the computed number of segments. Further examination is facilitated by the zoomed-in views, as seen in FIGS. 10C and 10D, corresponding to highlighted areas in FIG. 10A. Overall, the systems and method proposed above demonstrate the capability to robustly and accurately calibrate directional data within the context of mud motor applications for directional drilling.

Additionally, it is noted that the methods and systems described above accommodate diverse data sources by allowing for the application of weighting before the data enters the algorithmic processing. Further, the methods and systems may be tailored for real-time calibration becomes feasible by constructing a carefully designed sliding window during the active drilling process. The calibration results obtained through this method serve dual purposes-they may function as real-time indicators of tool capability for advanced control strategies and act as signals for detecting tool malfunctions or rapid changes in drilling conditions. The versatility of the proposed methods and systems may extend to scenarios with an unknown number and location of segments, making it applicable to similar data processing situations. And it is also able to handle data scenarios that alternate between more than two modes, as outlined in this disclosure. The proposed methods and systems may be used with a more complex dynamic model as an alternative to Equation 1. The parameter uncertainty provided by the algorithm may be used to implement a robust control method.

Utilizing these methods and systems described above introduce a novel calibration method of steerability (tool yield) for mud motor, leveraging Bayesian statistical methods, specifically Reversible Jump Markov Chain Monte Carlo (RJMCMC). This method excels in the context of steerable mud motors, where the steering systems alternate between "rotate" mode 500 and "slide" mode 502, showcasing a distinctive behavior in the streaming directional data for each operational mode. This approach functions as an all-encompassing solution, skillfully addressing the unique challenges posed by real-time data in the context of mud motor operations. In most of the drilling jobs, recording of slide mode 502 and rotate mode 500 is carried out manually, with the information only becoming available in post-job reports. Hence, detecting the steering mode in real time, along with estimation of steerability for each mode, poses a considerable challenge. Real-time identification of these parameters is very crucial in terms of accurately placing the wellbore to meet predefined objectives and constraints. The disclosed method may precisely identify segment boundaries and execute segment-specific regression to capture the dynamic behavior within each mode, contributing to a precise and effective calibration process for enhanced steerability in mud motor applications.

Statement 1: A method may comprise disposing a bottom hole assembly that comprises a steering sub into a formation and taking a plurality of directional data measurements with one or more sensors disposed on the bottom hole assembly, wherein the plurality of directional data measurements comprises one or more slide modes and one or more rotate modes that are performed by the steering sub. The method may further comprise segmenting the plurality of directional data measurements into the one or more slide modes and the one or more rotate modes using at least in part a Reversible Jump Markov Chain Monte Carlo (RJMCMC) and calibrating the steering sub based at least in part on the segments to determine a tool yield between one or more steering inputs and responses measured in the plurality of directional data measurements.

Statement 2 The method of statement 1, wherein the one or more steering inputs are a toolface measurement or a steering ratio.

Statement 3 The method of any previous statements 1 or 2, wherein the RJMCMC removes noise from the plurality of directional data measurements.

Statement 4: The method of any previous statements 1-3, wherein the segmenting of the plurality of directional data measurements is determined using one or more perturbations, wherein the one or more perturbations are a death move, a birth move, or an update move.

Statement 5: The method of any previous statements 1-4, further comprising cataloging the tool yield.

Statement 6: The method of any previous statements 1-5, further comprising applying a weight to each of the plurality of directional data measurements.

Statement 7: The method of any previous statements 1-6, further comprising removing one or more duplicates and one or more outliers from the plurality of directional data measurements.

Statement 8: The method of any previous statements 1-7, further comprising identifying an initial noise level form the plurality of directional data measurements.

Statement 9: A system may comprise a bottom hole assembly. The bottom hole assembly may comprise a steering sub that steers the bottom hole assembly and one or more sensors that take a plurality of directional data measurements that comprise one or more slide modes and one or more rotate modes that are performed by the steering sub. The system may further comprise an information handling system. The information handling system may be configured to segment the plurality of directional data measurements into the one or more slide modes and the one or more rotate modes using a Reversible Jump Markov Chain Monte Carlo (RJMCMC) and calibrate the steering sub based at least in part on the segments to determine a relationship between one or more steering inputs and responses measured in the plurality of directional data measurements.

Statement 10: The system of statement 9, wherein the one or more steering inputs are a toolface measurement or a steering ratio.

Statement 11: The system of any previous statements 9 or 10, wherein the RJMCMC removes noise from the plurality of directional data measurements.

Statement 12: The system of any previous statements 9-11, wherein the segmenting of the plurality of directional data measurements is determined using one or more perturbations.

Statement 13: The system of statement 12, wherein the one or more perturbations are a death move, a birth move, or an update move.

Statement 14: One or more non-transitory machine-readable media including instructions executable by a processor. Instructions may comprise instructions to take a plurality of directional data measurements with one or more sensors disposed on a bottom hole assembly, wherein the plurality of directional data measurements comprises one or more slide modes and one or more rotate modes that are performed by a steering sub. The instructions may further comprise instructions to segment the plurality of directional data measurements into the one or more slide modes and the one or more rotate modes using a Reversible Jump Markov Chain Monte Carlo (RJMCMC) and instructions to calibrate the steering sub based at least in part on the segments to determine a relationship between one or more steering inputs and responses measured in the plurality of directional data measurements.

Statement 15: The machine-readable media of statement 14, wherein the one or more steering inputs are a toolface measurement or a steering ratio.

Statement 16: The machine-readable media of any previous statements 14 or 15, wherein the RJMCMC removes noise from the plurality of directional data measurements.

Statement 17: The machine-readable media of any previous statements 14-16, wherein the segmenting of the plurality of directional data measurements is determined using one or more perturbations.

Statement 18: The machine-readable media of statement 17, wherein the one or more perturbations are a death move, a birth move, or an update move.

Statement 19: The machine-readable media of any previous statements 14-18, further comprising instructions to apply a weight to each of the plurality of directional data measurements.

Statement 20: The machine-readable media of any previous statements 14-18, further comprising instructions to remove one or more duplicates and one or more outliers from the plurality of directional data measurements.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any comprised range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

disposing a bottom hole assembly that comprises a steering sub into a formation taking a plurality of directional data measurements with one or more sensors disposed on the bottom hole assembly, wherein the plurality of directional data measurements comprises one or more slide modes and one or more rotate modes that are performed by the steering sub;

segmenting the plurality of directional data measurements into the one or more slide modes and the one or more rotate modes using at least in part a Reversible Jump Markov Chain Monte Carlo (RJMCMC);

calibrating the steering sub in real time based at least in part on the segments to determine a tool yield between one or more steering inputs and responses measured in the plurality of directional data measurements; and steering the bottom hole assembly with the calibrated steering sub.

2. The method of claim 1, wherein the one or more steering inputs are a toolface measurement or a steering ratio.

3. The method of claim 1, wherein the RJMCMC removes noise from the plurality of directional data measurements.

4. The method of claim 1, wherein the segmenting of the plurality of directional data measurements is determined using one or more perturbations, wherein the one or more perturbations are a death move, a birth move, or an update move.

5. The method of claim 1, further comprising cataloging the tool yield.

6. The method of claim 1, further comprising applying a weight to each of the plurality of directional data measurements.

7. The method of claim 1, further comprising removing one or more duplicates and one or more outliers from the plurality of directional data measurements.

8. The method of claim 1, further comprising identifying an initial noise level form the plurality of directional data measurements.

9. A system comprising:

a bottom hole assembly that comprises:

a steering sub that steers the bottom hole assembly; and one or more sensors that take a plurality of directional data measurements that comprise one or more slide modes and one or more rotate modes that are performed by the steering sub; and an information handling system configured to:

segment the plurality of directional data measurements into the one or more slide modes and the one or more rotate modes using a Reversible Jump Markov Chain Monte Carlo (RJMCMC);

calibrate the steering sub in real time based at least in part on the segments to determine a relationship between one or more steering inputs and responses measured in the plurality of directional data measurements; and steer the bottom hole assembly with the calibrated steering sub.

10. The system of claim 9, wherein the one or more steering inputs are a toolface measurement or a steering ratio.

11. The system of claim 9, wherein the RJMCMC removes noise from the plurality of directional data measurements.

12. The system of claim 9, wherein the segmenting of the plurality of directional data measurements is determined using one or more perturbations.

13. The system of claim 12, wherein the one or more perturbations are a death move, a birth move, or an update move.

14. One or more non-transitory machine-readable media including instructions executable by a processor, instructions comprising:

instructions to take a plurality of directional data measurements with one or more sensors disposed on a bottom hole assembly, wherein the plurality of directional data measurements comprises one or more slide modes and one or more rotate modes that are performed by a steering sub;

instructions to segment the plurality of directional data measurements into the one or more slide modes and the one or more rotate modes using a Reversible Jump Markov Chain Monte Carlo (RJMCMC);

instructions to calibrate the steering sub in real time based at least in part on the segments to determine a relationship between one or more steering inputs and responses measured in the plurality of directional data measurements; and instructions to steer the bottom hole assembly with the calibrated steering sub.

15. The machine-readable media of claim 14, wherein the one or more steering inputs are a toolface measurement or a steering ratio.

16. The machine-readable media of claim 14, wherein the RJMCMC removes noise from the plurality of directional data measurements.

17. The machine-readable media of claim 14, wherein the segmenting of the plurality of directional data measurements is determined using one or more perturbations.

18. The machine-readable media of claim 17, wherein the one or more perturbations are a death move, a birth move, or an update move.

19. The machine-readable media of claim 14, further comprising instructions to apply a weight to each of the plurality of directional data measurements.

20. The machine-readable media of claim 14, further comprising instructions to remove one or more duplicates and one or more outliers from the plurality of directional data measurements.

* * * * *